US006588960B1

(12) United States Patent
Barwin et al.

(10) Patent No.: US 6,588,960 B1
(45) Date of Patent: Jul. 8, 2003

(54) LIQUID DISPENSER AND APPLICATOR

(76) Inventors: Robyn Barwin, 188 Banbury Road, Toronto, Ontario (CA), M3B 3C5; Sidney Barwin, 188 Banbury Road, Toronto, Ontario (CA), M3B 3C5

( * ) Notice: Subject to any disclaimer, the term of this patent is extended or adjusted under 35 U.S.C. 154(b) by 0 days.

(21) Appl. No.: 09/869,786

(22) PCT Filed: Jan. 4, 2000

(86) PCT No.: PCT/CA00/00004

§ 371 (c)(1),
(2), (4) Date: Jul. 3, 2001

(87) PCT Pub. No.: WO00/40340

PCT Pub. Date: Jul. 13, 2000

(30) Foreign Application Priority Data

Jan. 4, 1999 (CA) ..... 2257738

(51) Int. Cl.[7] ..... A45D 40/00
(52) U.S. Cl. ..... 401/125; 401/123

(58) Field of Search ..... 401/124, 125, 401/123, 131, 139, 261, 262

(56) References Cited

U.S. PATENT DOCUMENTS 711,679 A * 10/1902 Ritz ..... 401/125
3,168,984 A * 2/1965 Corning et al. ..... 401/125 X

* cited by examiner

*Primary Examiner*—David J. Walczak
*Assistant Examiner*—Kathleen J. Prunner

(57) ABSTRACT

A liquid dispenser and applicator (10) is provided having a reservoir (302) for holding a liquid such as a liquid foundation and having a bottleneck (308) through which the liquid may be dispensed. An applicator (304) is nestled underneath the reservoir such that the reservoir and applicator are in a vertically stacked relationship, thus permitting a compact arrangement. A detent mechanism is provided for attaching the applicator to the reservoir, the applicator being detachable from the reservoir in order to receive liquid from the spout and permit the applicator to be used to apply the liquid to a surface.

6 Claims, 11 Drawing Sheets

LIQUID DISPENSER AND APPLICATOR

FIELD OF THE INVENTION

The invention relates to the field of liquid dispensers and applicators and more particularly to dispensers and applicators such as might be used, for example, for storing and handling various liquids including liquid cosmetics or medical ointments.

BACKGROUND OF THE INVENTION

Various types of cosmetic make-up are available. Types of cosmetic make-up include pressed powder, creme and liquid make-up. One of the advantages of liquid make-up over creme or pressed powder make-up is that liquid make-up is generally easier to blend onto a user's skin than either pressed powder or creme. Liquid foundation is one type of liquid make-up. Liquid foundation generally has a thick or pasty consistency which gives the liquid foundation good coverage on a user's skin. Liquid foundation allows for quick application to the user's skin and may also include moisturizers and ingredients which provide protection from harmful solar rays.

Various methods are available for applying liquid foundation ranging from simply using one's finger tips to the use of various types and styles of foam blending pads specifically designed for the application of cosmetics. Such foam blending pads are popular applicators for liquid foundation as they provide a convenient application method for the liquid foundation which is generally less messy than using fingers. Typically, the liquid foundation is applied to the foam applicator by pouring small amounts of foundation from a bottle containing the foundation onto a surface of the foam applicator. The foam applicator is then used to blend the liquid foundation onto the skin of the user.

The use of a foam applicator for the application of liquid foundation also presents disadvantages. First, the foam applicator may be unhygienic, particularly if used repeatedly, as it may pick up dust, dirt and liquids. Foam applicators have a tendency to become dirty easily. Foam applicators are often left on counter tops or near sinks where they are exposed to dust, liquids and other unsanitary substances. These particles of dirt may end up on a user's skin and clog the user's pores causing blemishes, pimples or infections. For this reason, it is often recommended to dispose of a foam applicator after one application of liquid foundation or alternately, thoroughly to wash, to dry and then properly to store the foam applicator to avoid contamination. Disposal of used foam applicators and the need to maintain a supply of new foam applicators may be inconvenient or expensive, or both. Therefore, users typically throw out foam applicators only after several applications. It may be inconvenient or impractical for a user to take multiple foam applicators with them when going out in order to reapply or touch up their make-up.

Furthermore, although foam applicators are generally less messy than using finger tips, liquid foundation has a tendency to seep through the foam applicator and may soil a user's hands when the foam applicator is being used. Hand washing is thus often necessary after each use of a foam applicator to avoid the potential of soiling clothes and other items from the user's dirty hands. Often a user may wish to apply or touch up their make-up at a time or place when they do not have access to the necessary facilities for washing their hands. For this reason, a foam applicator is often inconvenient and may result in a user choosing another form of foundation which, although not as effective as liquid foundation, is not as messy.

Where a foam applicator is used with a bottle of liquid foundation, the foam applicator may contaminate the contents of the bottle. For example, if foundation is applied to a previously used foam applicator by covering the opening of the bottle with the foam applicator and then tipping the bottle upside down, contaminants on the foam applicator may be transferred to the contents of the bottle.

Another disadvantage of foam applicators heretofore has been their tendency to soil the interior of a handbag or pocket unless properly protected. In the past, foam applicators were sometimes carried in small plastic bags or make-up bags. These methods for storing foam applicators do not prevent the foundation from smearing on the inside of the plastic bag or make-up bag or on their other contents.

Thus, there is a need for a hygienic liquid foundation applicator which reduces the mess caused by conventional foam applicators. In addition there is a need for a portable system for dispensing and applying liquid foundation.

SUMMARY OF THE INVENTION

According to one aspect of the invention, a liquid dispensing apparatus has a reservoir for containing a liquid, and a spout whence to dispense the liquid. An applicator is attached to the reservoir for receiving the liquid from the spout. The applicator is detachable from the reservoir to permit the applicator to be used to apply the liquid to a surface.

According to another aspect, the invention provides a liquid dispenser having a reservoir for containing a liquid for application to a surface. An applicator holder is attachable to the reservoir and detachable therefrom. The reservoir has a spout for dispensing the liquid onto an applicator element held by the applicator holder.

According to a further aspect, the invention provides a liquid dispensing apparatus having a reservoir for containing a liquid for application to skin and having a spout through which to dispense the liquid. A lid is attachable to the reservoir for enclosing the spout. An applicator is attached to the lid and is detachable therefrom. When the applicator is attached to the lid and the lid is attached to the reservoir, the applicator is enclosed by the lid.

According to a still further aspect, the invention provides an applicator having a handle and a transport element. The handle has a surface for a user to grasp and a seat. The transport element is formed to engage the seat or other portion of the applicator holder.

According to yet another aspect, the invention provides an apparatus having a sheath with an open end. An applicator for receiving a liquid and applying the liquid to a surface is slidably receivable in the sheath and is movable from the interior of the sheath to emerge from the open end of the sheath. The liquid is dispensed onto the applicator when the applicator is emerged from the sheath, and the liquid is applied to the surface with the applicator by a user holding the sheath.

The apparatus may have a cover for closing the open end of the sheath when the applicator is enclosed in the sheath. The applicator may include a sponge holder and a sponge attached to the sponge holder. A track may be provided on an interior wall of the sheath. The sponge holder may have a foot corresponding to the track to be slidably receivable therein.

BRIEF DESCRIPTION OF DRAWINGS

Preferred embodiments of the present invention will next be described for purposes of illustration and not of limitation, all by reference to the following drawings in which.

DETAILED DESCRIPTION OF PREFERRED EMBODIMENTS

Figure 1:
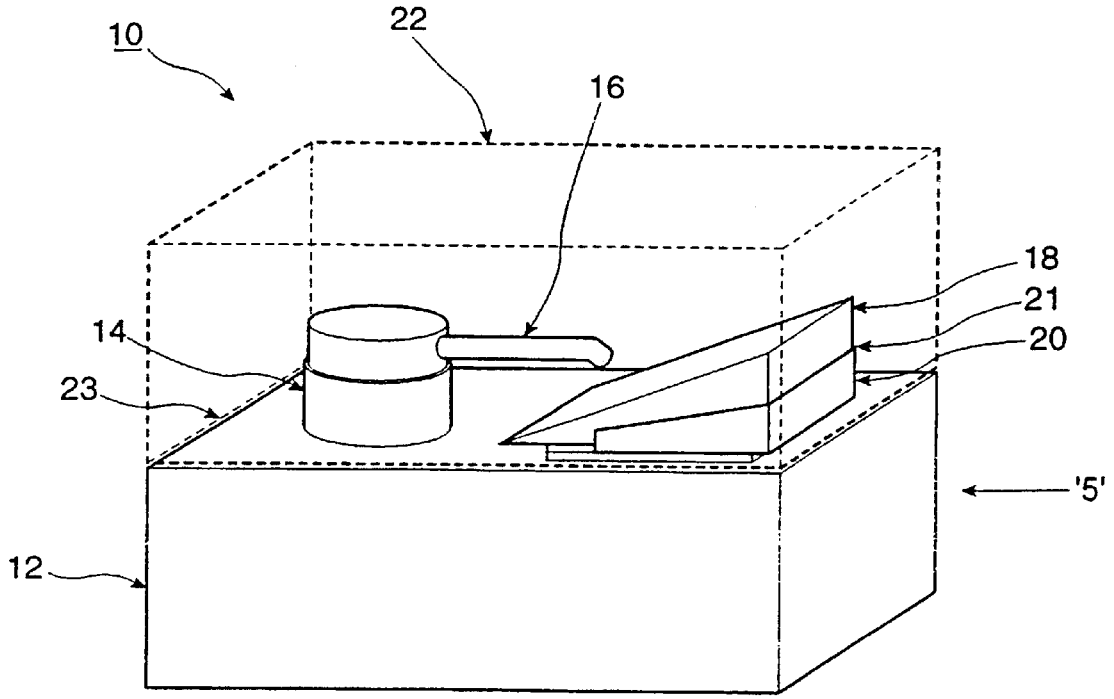
FIG. 1 is a three dimensional view of an example of a liquid dispenser and applicator according to a preferred embodiment of the present invention.

The description which follows, and the embodiments described therein, are provided by way of illustration of an example, or examples of particular embodiments of the principles of the present invention. These examples are provided for the purposes of explanation, and not of limitation, of those principles and of the invention. In the description which follows, like parts are marked throughout the specification and the drawings with the same respective reference numerals. The drawings are not necessarily to scale and in some instances proportions may have been exaggerated in order more clearly to depict certain features of the invention.

FIG. 1 shows a preferred embodiment of a liquid cosmetics dispenser and applicator indicated generally as 10, according to the principles of the present invention. Dispenser and applicator 10 has a reservoir 12 having a pump 14 mounted on the top of reservoir 12. Reservoir 12 contains a liquid such as liquid foundation which may be pumped from reservoir 12 using pump 14. When pump 14 is pumped, the liquid contained in reservoir 12 is dispensed from reservoir 12 via a discharge outlet in the nature of a spout 16 of pump 14. The tip of spout 16 is positioned over a cosmetic application element in the nature of a sponge 18, mounted to an element carrier in the nature of a sponge holder 20. Together sponge 18 and sponge holder 20 serve as an applicator 21 for applying the liquid foundation to a user's skin. In the preferred embodiment, sponge 18 is glued to sponge holder 20 with an adhesive which allows sponge 18 to be removed from sponge holder 20 and replaced with a fresh sponge. Alternatively, sponge holder 20 may be sized relative to sponge 18 to hold sponge 18 with a friction fit, sponge 18 is preferably wedge shaped as shown in FIG. 1, but it may have other shapes which may be considered useful or expedient in the circumstances. The invention is not limited to sponges but may include other types of liquid applicators such as fabric pads, porous membranes, webs, or cotton balls, foams or rubber.

Instead of having pump 14 for dispensing liquid foundation, reservoir 12 may have a simpler means for dispensing the liquid foundation such as a bottleneck with a screw top, flip lid, or a simple spout through which the liquid foundation may be poured. Where a pump or similar means is supplanted by a pouring spout, the liquid foundation can be dispensed from reservoir 12 by tipping reservoir 12 to permit gravity to cause the liquid foundation to be dispensed from the bottleneck or spout. Pump 14 is the preferred means for dispensing the liquid foundation from reservoir 12 as it will tend to reduce or discourage a mess from forming and does not require a cap or lid to discourage or prevent the unwanted escape of liquid foundation therefrom. Pump 14 also aids to prevent the contamination of the liquid contained in reservoir 12 from sponge 18. For this reason, spout 16 preferably does not contact sponge 18 when dispenser and applicator 10 is used.

Figure 2:
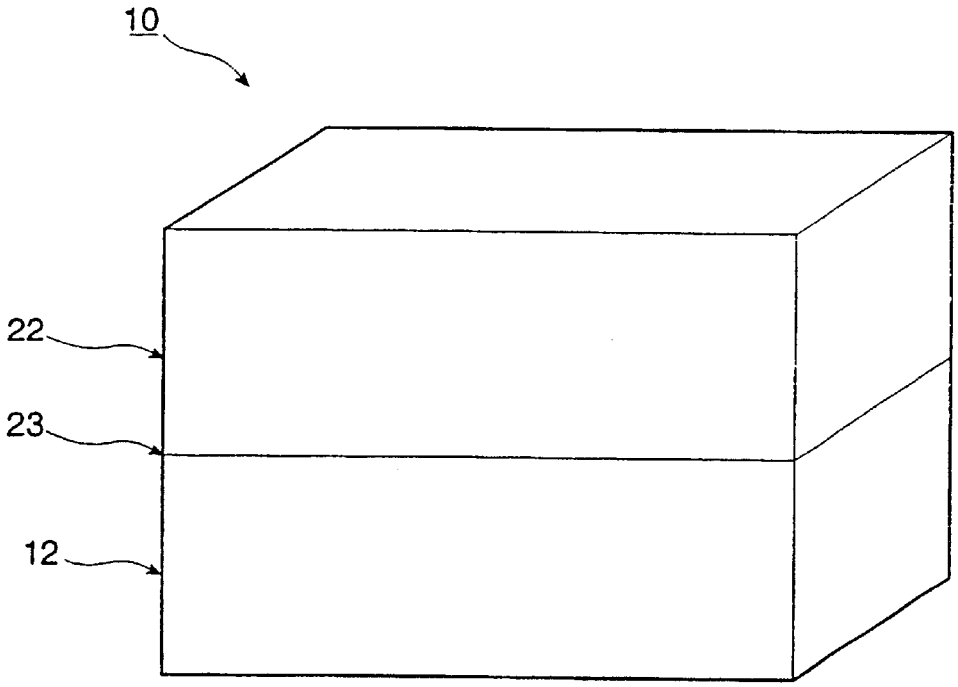
FIG. 2 is a three dimensional view of the liquid dispenser and applicator of FIG. 1 with a lid.

Sponge holder 20 is detachable from reservoir 12 to permit it to be used to apply the liquid foundation. Referring to FIGS. 1 and 2, dispenser and applicator 10 may also have a lid 22 which fits onto the reservoir 12 to enclose pump 14, sponge 18 and sponge holder 20. Lid 22 is shown in FIG. 1 in dotted lines so as not to obscure the view of the pump 14, sponge 18 and sponge holder 20. FIG. 2 shows dispenser and applicator 10 with lid 22 in place on reservoir 12, enclosing pump 14, sponge 18 and sponge holder 20. Lid 22 is preferably hingedly attached along one of its bottom edges to a top edge of the reservoir 12 to enable dispenser and applicator 10 to be hingedly opened and closed along a hinged edge 23 to expose pump 14, sponge 18 and sponge holder 20 without having fully to separate lid 22 from reservoir 12. Alternatively, lid 22 may be fitted to reservoir 12 with a friction fit, a snap fit, or a detent to prevent lid 22 from freely falling off of reservoir 12 when in place. Other means are possible for attaching lid 22 to the reservoir 12 to enclose pump 14, sponge 18 and sponge holder 20.

Figure 3A:
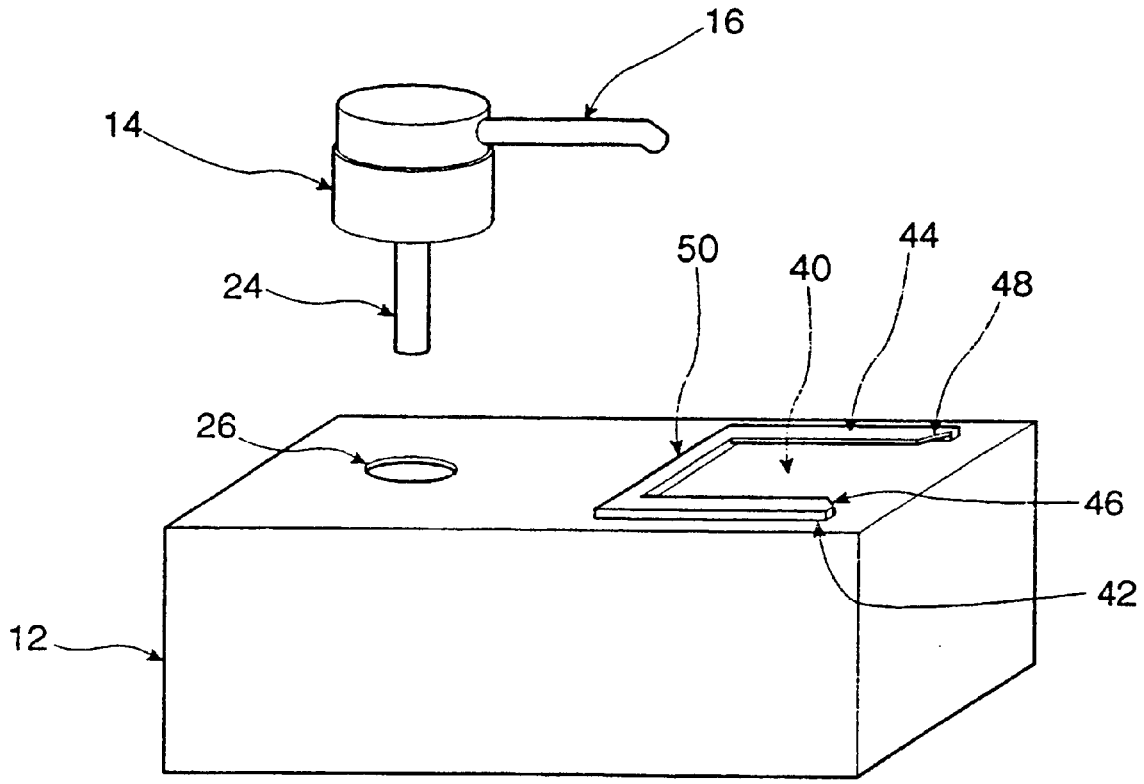
FIG. 3*a* is an exploded view of the reservoir and pump of the dispenser and applicator of FIG. 1.
Figure 3B:
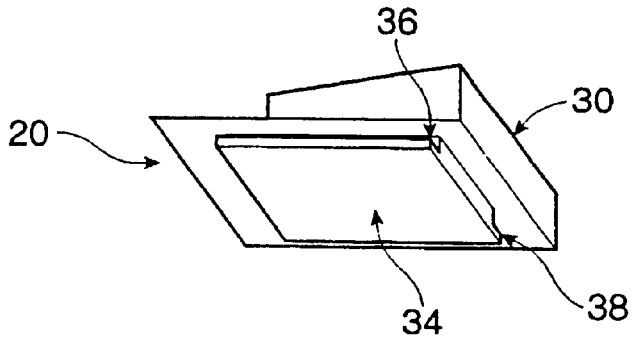
FIG. 3*b* is a three-dimensional view of the sponge holder of the liquid dispenser and applicator of FIG. 1.
Figure 4:
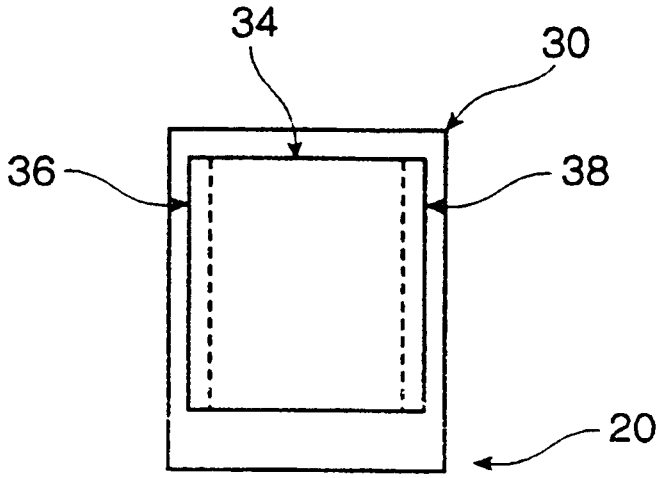
FIG. 4 is a bottom view of the sponge holder of the liquid dispenser and applicator of FIG. 1.
Figure 5:
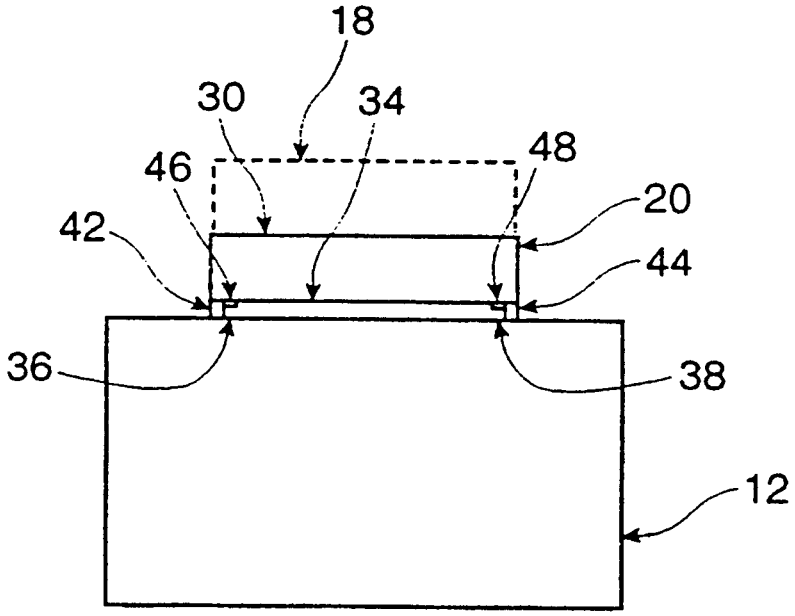
FIG. 5 is a side view of the reservoir, sponge and sponge holder of the liquid dispenser and applicator of FIG. 1 as viewed on Arrow '5'.

Referring now to FIGS. 3*a* and 3*b*, reservoir 12, pump 14 and sponge holder 20 may be viewed in their disassembled state. Pump 14 has a tube 24 connected to spout 16 to provide a conduit for supplying liquid from reservoir 12 to spout 16. Reservoir 12 has a reservoir opening 26 for receiving tube 24 of pump 14. When assembled, pump 14 is preferably permanently affixed or glued to provide a seal about reservoir opening 26. Alternatively, reservoir 12 may include a threaded neck surrounding the reservoir hole 26 onto which pump 14 may be screwed to be removeably attached thereto. In such a case, pump 14 would be correspondingly threaded to mate with the neck of reservoir 12. With pump 14 being removable the user is able to refill reservoir 12 with liquid foundation when the original supply is exhausted. Other methods for attaching pump 14 to reservoir 12 are possible.

Referring now to FIGS. 3*a*, 3*b*, 4 and 5, sponge holder 20 has a mount, or seat, in the nature of a cradle portion 30 for receiving and holding sponge 18. In the preferred embodiment, cradle portion 30 is sized to fit a foam wedge having a rectangular base with a length of approximately two inches and a width of approximately one inch. Thus, cradle portion 30 has similar dimensions to accommodate the base of the foam wedge. Sponge 18 is preferably made from a latex foam. However, other materials may alternatively be used for sponge 18. Sponges may also come in other shapes and sizes. For example sponge 18 may alternatively be a rectangular block or may have a rounded or bulbous end.

Figure 6:
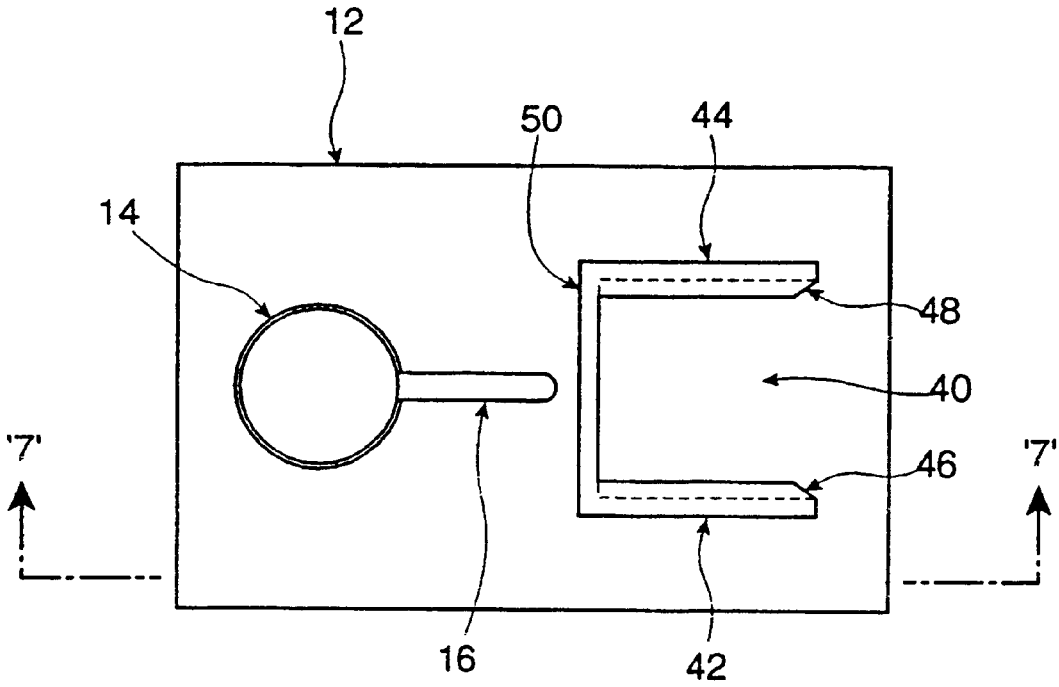
FIG. 6 is a top view of the pump and reservoir of the liquid dispenser and applicator of FIG. 1.

Sponge holder 20 also has a foot 34 on the underside of cradle portion 30. Foot 34 protrudes from cradle portion 30 and has a pair of substantially parallel, spaced apart flanges 36, 38. Referring additionally to FIG. 6, reservoir 12 has a shoe, socket or guideway in the nature of a track 40. Flanges 36, 38 act as guide followers by which foot 34 slidably engages track 40. Track 40 includes a first edge 42 and a second edge 44 on either side, each having a flange 46, 48 which corresponds to flanges 36, 38 on foot 34 of sponge holder 20. The width of the channels formed between flanges 46, 48 and the top surface of reservoir 12 is slightly greater than the thickness of flanges 36, 38 such that foot 34 may be received in track 40 with a friction fit. This prevents sponge holder 20 from freely sliding out of track 40. Track 40 also has a stop 50 at the end of track 40 which is proximate to pump 14 to arrest the sliding of sponge holder 20 when foot 34 contacts stop 50.

The distal ends of flanges 46, 48 are preferably shaped so as not to present right angles at the ends of flanges 46, 48. The slanted ends of flanges 46, 48 tend to guide flanges 36, 38 of foot 34 into the channels of track 40 provided at the first edge 42 and second end 44.

Other means are possible for attaching sponge holder 20 to reservoir 12 such that it is detachable therefrom. For example, foot 34 and track 40 could be replaced by strips of Velcro™ with one portion of a hook and loop fabric strip fastening system attached to the bottom of sponge holder 20, while a corresponding portion is attached to the top surface of reservoir 12. The first fabric strip can be glued to the bottom of the sponge holder 20 and the second fabric strip can be glued to the top surface of the reservoir 12. The first fabric strip releasably adheres to the second fabric strip when the strips are pressed together.

Referring to FIGS. 1 and 6, when sponge 18 and sponge holder 20 are attached to reservoir 12, a portion of sponge 18 is preferably positioned under spout 16. When liquid foundation is pumped from reservoir 12, it is dispensed from pump 14 through spout 16 directly onto sponge 18. When sufficient liquid foundation has been dispensed onto sponge 18, sponge holder 20 and sponge 18 can be slidably detached from reservoir 12 and can then be used to apply the liquid foundation to a user's skin. In addition to providing a means for attaching sponge 18 to reservoir 12, sponge holder 20 also serves as a holder or handle which the user may grasp when applying the liquid foundation with sponge 18. By holding onto sponge holder 20, the user can avoid directly touching and contaminating sponge 18 and can thereby tend to avoid soiling his or her fingers with liquid foundation that may seep through sponge 18.

Sponge holder 20 also provides a firmer support for sponge 18 which may tend to facilitate application of the liquid foundation to be applied to a user's face.

Referring to FIGS. 1 and 2, lid 22 provides a protective covering for pump 14, sponge 18 and sponge holder 20. Thus, lid 22 prevents dust and other contaminants from contacting sponge 18. By keeping sponge 18 relatively clean, sponge 18 may be used for a greater number of applications than an unprotected sponge which might be exposed to liquids and airborne contaminants such as dust and dirt. In addition, lid 22 provides a protective covering for pump 14, sponge 18 and sponge holder 20 such that the risk of soiling other articles and personal effects with liquid foundation is reduced when the entire dispenser and applicator 10 is placed into a user's purse, handbag or luggage.

When the user has used sponge 18 for a number of applications such that sponge 18 requires replacing, the user can remove sponge 18 from sponge holder 20 and place a fresh sponge 18 into cradle portion 30. Sponge 18 is preferably held in sponge holder 20 by glue. The glue used in sponge holder 20 preferably has certain adhesive properties which make the glue reusable such that after sponge 18 is removed from sponge holder 20 the glue is capable of receiving and adhering to a fresh replacement sponge. Sponge 18 may alternatively be attached to sponge holder 20 with double sided adhesive tape, a friction fit, a clip or other means.

Sponge 18 may alternatively be permanently affixed to sponge holder 20 such that applicator 21 is an integrated device. When applicator 21 becomes worn out or too dirty, the entire applicator may be replaced, not just sponge 18.

The dispenser and applicator 10 preferably has dimensions which make it practical for a user to treat the dispenser and applicator 10 as a portable item. In the preferred embodiment of FIG. 1 the dimensions are 1¼ inches×3¼ inches×1 inch for dispenser and applicator 10. Reservoir 12 preferably has an interior volume of approximately 30 to 35 ml, or approximately one fluid ounce, such that reservoir 12 is capable of holding the contents of a standard, one fluid ounce bottle of liquid foundation. This volume for reservoir 12 also enables dispenser and applicator 10 to have a manageable size which contributes to the portability of dispenser and applicator 10. Reservoir 12 may be made smaller to make dispenser and applicator 10 more discrete and portable in a small hand bag or even a pocket. Dispenser and applicator 10 could alternatively be made on a larger scale for use on a vanity or counter-top where portability is not a concern.

Sponge holder 20, reservoir 12, pump 14 and lid 22 may all be made of plastic. Various types of plastic may be used, with each type having its relative advantages and disadvantages. Where reservoir 12 does not include a pump, the plastic used for the reservoir 12 may be flexible such that liquid foundation may be dispensed by the user tipping and squeezing reservoir 12.

Figure 7:
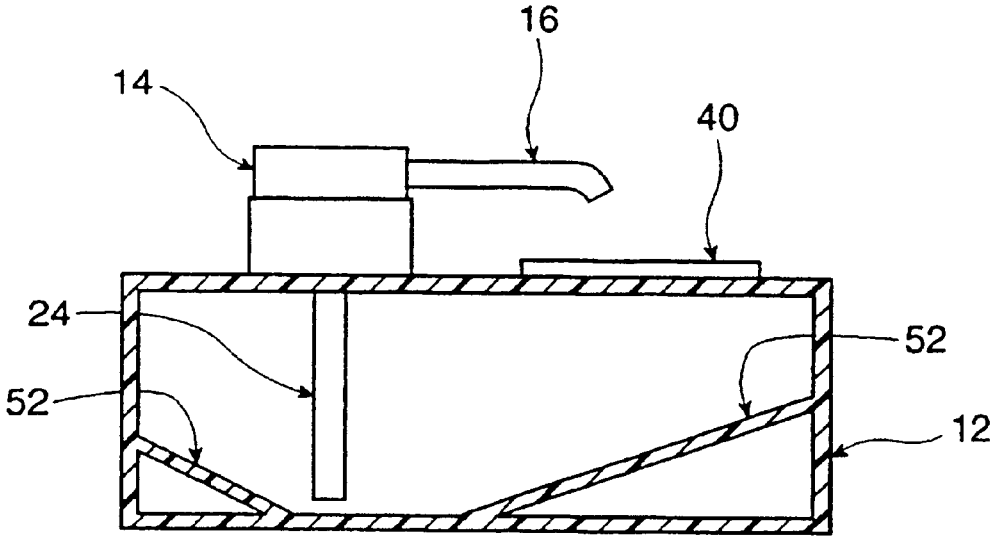
FIG. 7 is a cross-sectional view of the reservoir and pump of FIG. 6 taken on Section '7'.

Referring now to FIG. 7, the interior of reservoir 12 includes a sloping bottom or a sump 52 such that liquid foundation contained therein will collect in reservoir 12 near tube 24 of pump 14. Sump 52 encourages liquid foundation to pool in the area of tube 24 when the supply of liquid foundation in reservoir 12 is nearly exhausted. By pooling around tube 24, a greater amount of liquid foundation can be more efficiently extracted by the user before having either to dispose of dispenser and applicator 10, or, where reservoir 12 is refillable, to refill reservoir 12.

Where pump 14 is removable from reservoir 12, reservoir 12 may be refilled when the supply of liquid foundation contained therein has been exhausted. The liquid foundation is preferably contained in reservoir 12 directly. In other alternative embodiments, a plastic bag or bladder removable from reservoir 12 may be provided to hold the liquid foundation. The bag or bladder could be replaceable such that when the supply of liquid foundation in the bag is exhausted, the bag or bladder is replaced. The advantages of storing the liquid foundation in a bag or bladder is that the mess created when refilling reservoir 12 may tend to be reduced. In addition, the exhausted bladder may be removed from reservoir 12 and squeezed so as to remove a higher proportion of the liquid foundation before disposing of the bladder. This is particularly advantageous because of the cost of liquid foundation, which may be considerable for premium brands of cosmetics.

Alternate designs and shapes for dispenser and applicator 10 are possible. For example, in FIG. 8, a dispenser and applicator 60 having a more rounded design is shown. Dispenser and applicator 60 has similar functional features as dispenser and applicator 10 shown in FIGS. 1 to 7 such as a reservoir 62, a pump 64 with a spout 66, a sponge 68, a sponge holder 70 and a lid 72. Reservoir 62 has a track 74 in which sponge holder 70 is slidably received. Track 74 has a dovetail shape and receives a foot (not shown) of sponge holder 70 which is correspondingly dovetail shaped. Track 74 also has a stop 76 which arrests the sliding of sponge holder 70 when the foot (not shown) of sponge holder 70 contacts stop 76.

The more rounded design of dispenser and applicator 60 may provide several advantages. The rounded edges may make the reservoir 62 and lid 72 more durable and less likely to chip or break. The rounded design may also facilitate production in an injection moulding manufacturing process.

Figure 8:
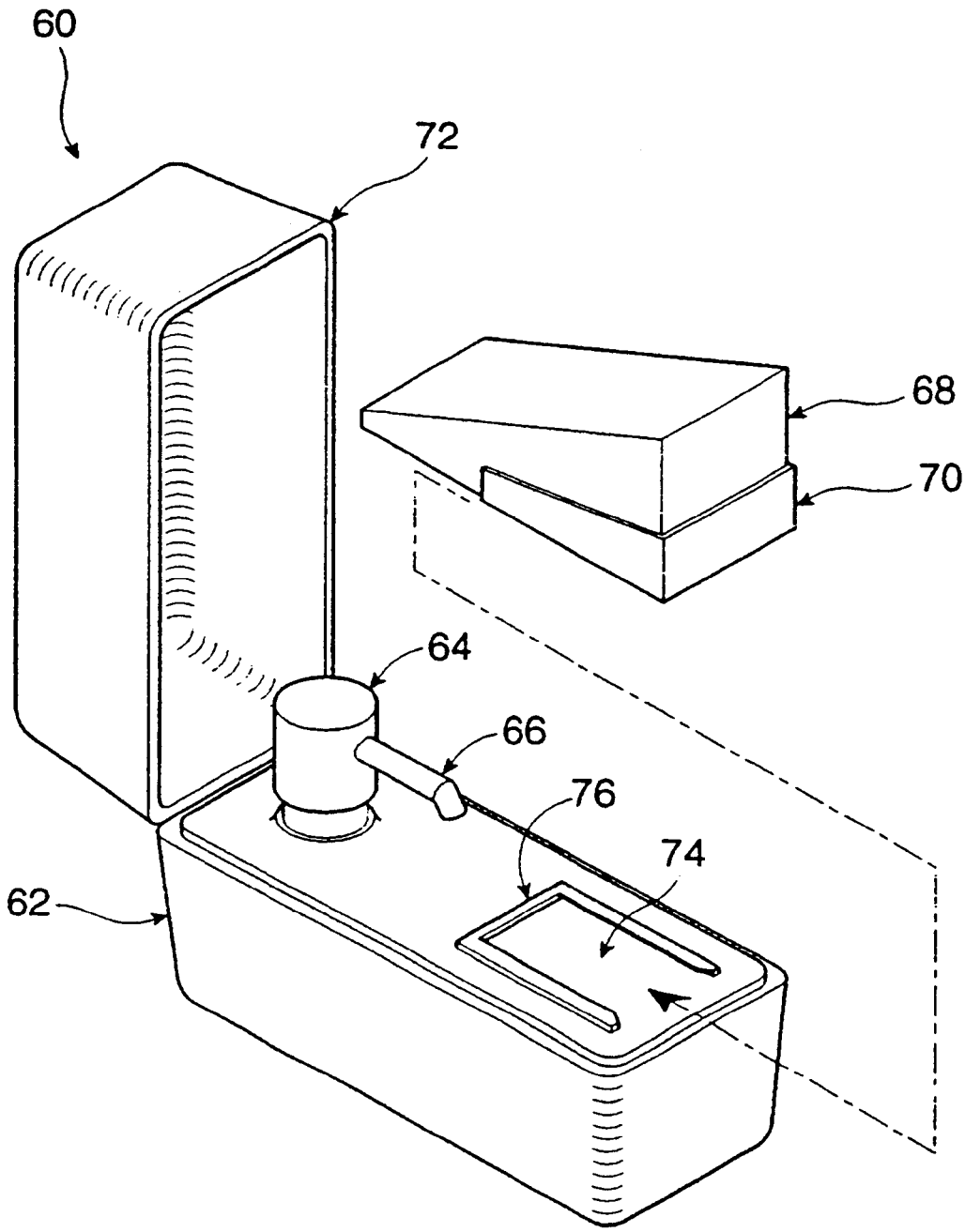
FIG. 8 is an isometric view of an example of a liquid dispenser and applicator according to a first alternative embodiment of the present invention.
Figure 9:
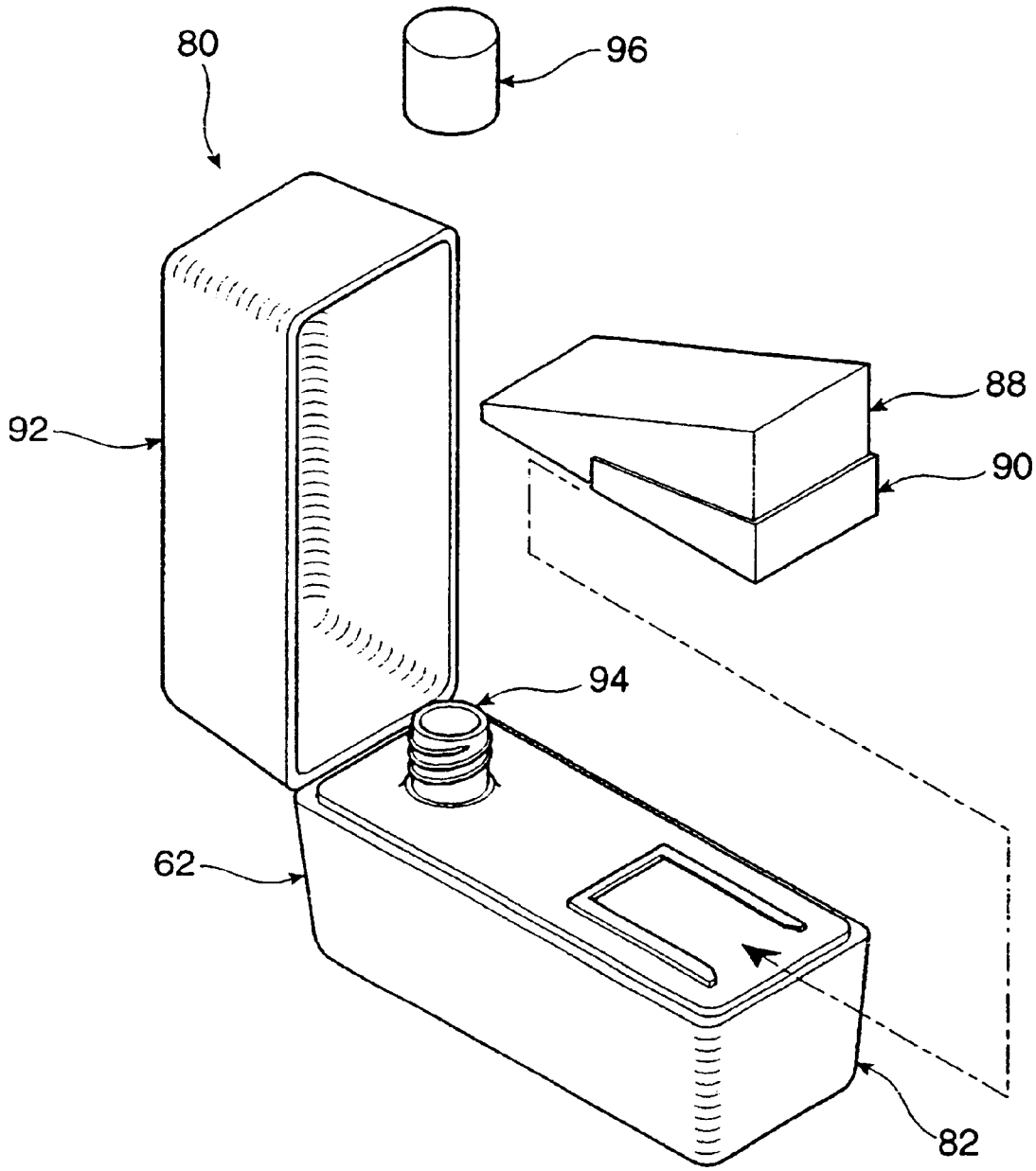
FIG. 9 is an isometric view of an example of a liquid dispenser and applicator according to a second alternative embodiment of the present invention.

Referring to FIG. 9, another alternative embodiment of the invention is shown. A dispenser and applicator 80 similar to dispenser and applicator 60 of FIG. 8 is shown. Dispenser and applicator 80 has a reservoir 82, a sponge 88, a sponge holder 90 and a lid 92 which are similar to the corresponding features of dispenser and applicator 60. However, instead of having a pump, dispenser and applicator 80 has a threaded bottleneck 94 and a cap 96. The interior walls (not shown) of cap 96 are correspondingly threaded to mate with the threads on bottleneck 94. Thus, cap 96 may be screwably attached to bottleneck 94 in order to seal reservoir 82. To use dispenser and applicator 80, cap 96 is unscrewed from bottleneck 94 to open reservoir 82. The user slidably removes sponge holder 90 and sponge 88 from reservoir 82 and then tips reservoir 82 to dispense liquid foundation onto sponge 88 through bottleneck 94. The dispensing of liquid foundation from reservoir 82 is aided by gravity which draws liquid foundation to bottleneck 94 when reservoir 82 is tipped. Sponge 88 and sponge holder 90 may then be used to apply the liquid foundation to a user's skin. When the application is completed, sponge 88 and sponge holder 90 may be replaced onto reservoir 82 and cap 96 may be screwed back onto bottleneck 94. Dispenser and applicator 80 may be less expensive to manufacture than dispenser and applicator 60 as a result of using bottleneck 94 and cap 96 instead of a pump.

Although described above in connection with a dispenser for liquid foundation, it will be appreciated that a sponge holder may be useful on its own for protecting the fingers of a user from becoming soiled by liquid foundation dispensed from other types of foundation dispensers and containers. Thus, it will be appreciated that applicator 21 of FIG. 1, which includes sponge 18 and sponge holder 20, may be used in connection with other types of liquid foundation dispensers. For example, applicator 21 can be used with a conventional bottle of liquid foundation as is readily available at cosmetics counters and at drugstores.

Figure 10:
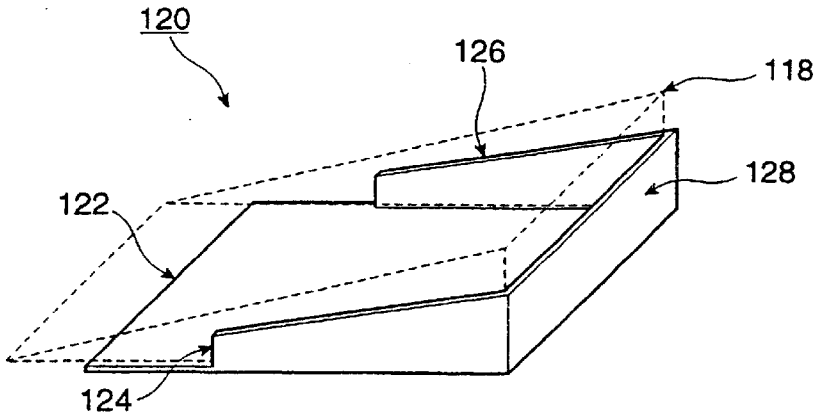
FIG. 10 is a three-quarter view of a sponge holder according to a third alternative embodiment of the present invention.

Referring to FIG. 10, a simplified sponge holder 120 is shown for use with a wide variety of types of liquid foundation dispensers. Sponge holder 120 has a base 122 to which a sponge 118 (shown in dotted line) can be affixed by a clip, friction fit, glue, tape or other means. Sponge 118 is preferably glued to sponge holder 120. The shape of base 122 of sponge holder 120 is preferably rectangular to accommodate the rectangular base of a conventional foam wedge. Sponge holder 120 also has two side walls 124, 126 and a back wall 128. The dimensions of sponge holder 120 correspond to the size of sponge 118. Side walls 124, 126 and back wall 128 preferably do not rise to the height of sponge 118 such that more of sponge 118 is exposed and may be used for applying the liquid foundation. It is also important for the walls 124, 126, 128 to be low so that they do not scratch the user's skin when sponge holder 120 is used.

A user may handle sponge 118 by touching only sponge holder 120 with his or her fingers. Liquid foundation may be dispensed onto sponge 118 according to various known methods and applied to the user's skin with sponge 118 without any contact between sponge 118 and the user's fingers. Thus, sponge holder 120 may tend to reduce or eliminate soiling of a user's fingers from the seepage of liquid foundation through sponge 118.

Sponge holder 120 may also protect sponge 118 from contamination by liquids. When sponge 118 is placed on a counter, sink or other surface, sponge holder 120 will protect the bottom of sponge 118 from water or other liquids present on such surface.

Figure 11:
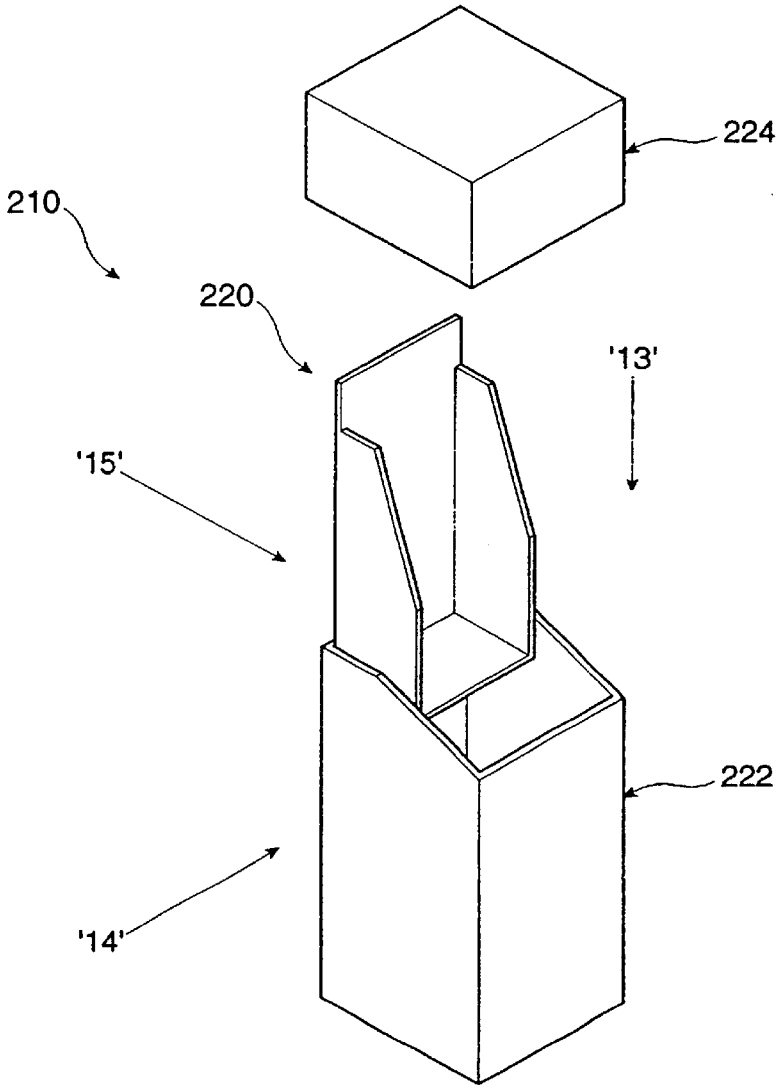
FIG. 11 is an isometric view of an applicator according to a fourth alternative embodiment of the present invention.

Referring to FIG. 11, an applicator 210 according to another alternative embodiment of the invention has a sponge holder 220 which is provided with a housing in the nature of a protective sheath 222 and a cap 224. The sponge holder 220 may slide in and out of sheath 222 when cap 224 is removed. Like previously described embodiments of the invention, sponge holder 220 is sized to hold a sponge such as a standard sized foam wedge.

Figure 12:
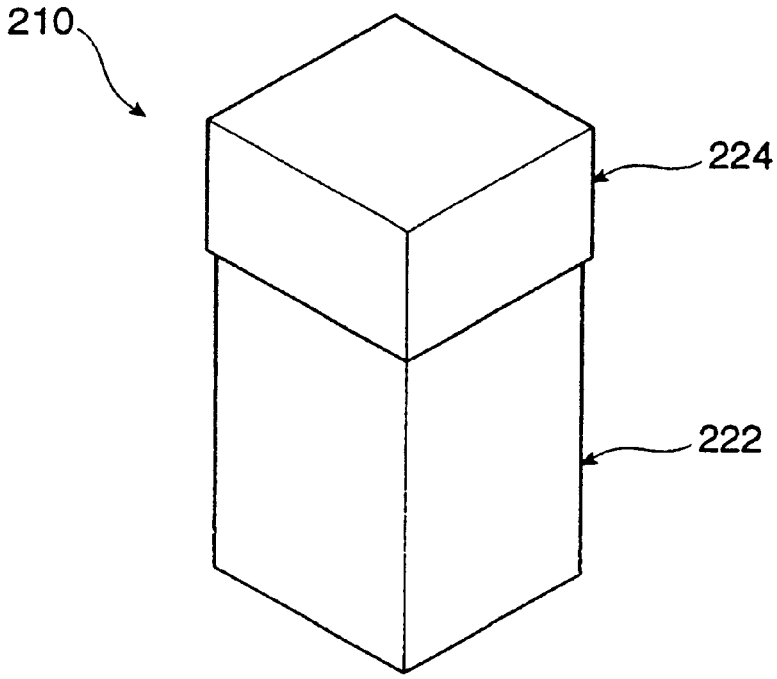
FIG. 12 is an isometric view of the applicator of FIG. 11.

Referring to FIG. 12, cap 224 fits onto sheath 222 to enclose sponge holder 220 and the sponge.

Figure 13:
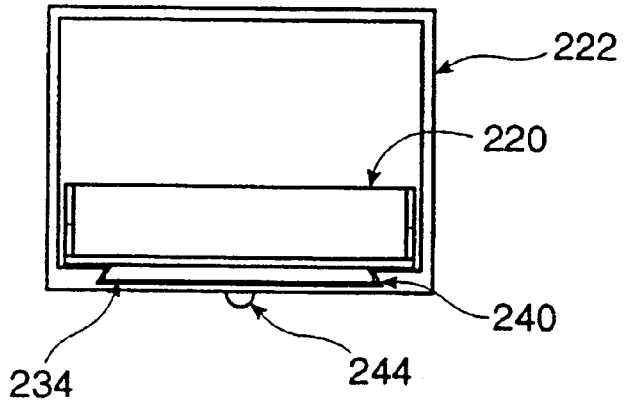
FIG. 13 is a top view of the sponge holder and sheath of the applicator of FIG. 11 as viewed on Arrow "13"
Figure 15:
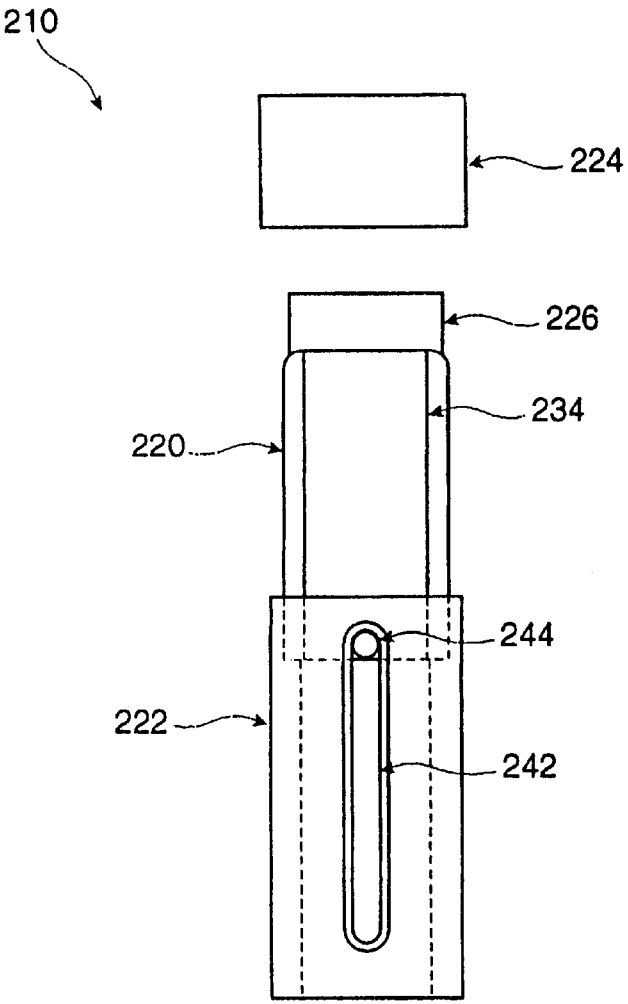
FIG. 15 is a side view of the applicator of FIG. 11 as viewed on Arrow '15'.
Figure 14:
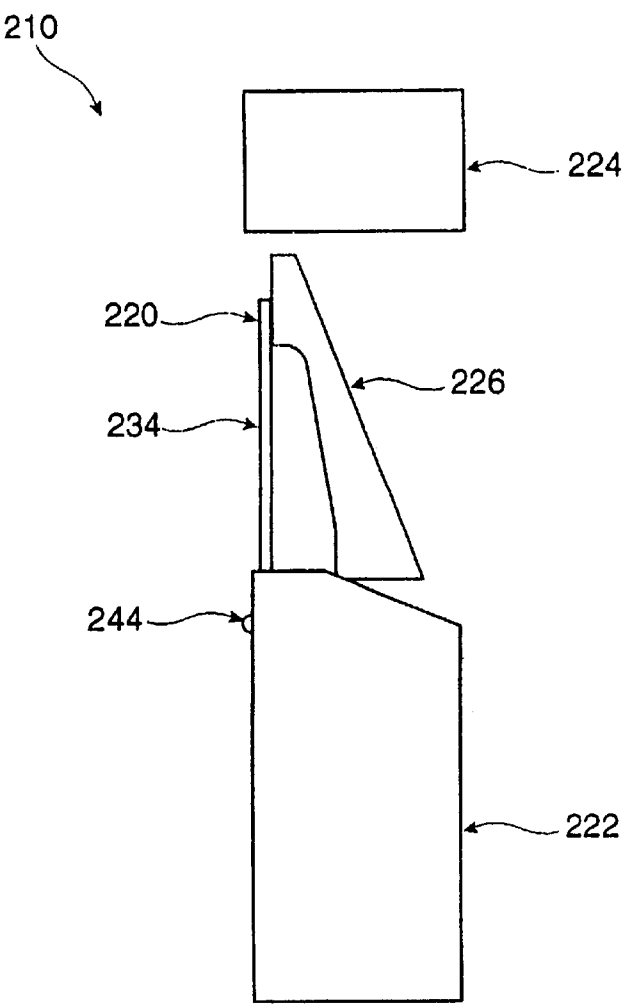
FIG. 14 is a side view of the applicator of FIG. 11 as viewed on Arrow '14'.

Referring to FIGS. 13, 14 and 15, a sliding carrier in the nature of a sponge holder 220 has a foot 234 with a dovetail shape for sliding engagement within a mating track 240 provided on an inside wall of sheath 222. Foot 234 and track 240 are sized such that sponge holder 220 may slide between a retracted, storage position within sheath 222, and an extended position for use in which sponge holder 240 stands outwardly, or proud of, the opening of sheath 222. The preferred shape for foot 234 and track 240 is the corresponding dovetail shape. However, other shapes for foot 234 and track 240 may be used. A slit 242 is also provided in sheath 222 along part of the length of track 240. A nub 244 is provided on the bottom of foot 234. Nub 244 fits into slit 242, the end of nub 244 standing proud of slit 242 such that nub 244 can be used to push and pull sponge holder 220 into and out of sheath 222. Nub 244 also guides sponge holder 220 as sponge holder 220 slides in and out of sheath 222.

To use applicator 210, cap 224 is removed from sheath 222. Cap 224 may be put on to the bottom of sheath 222 or may be stored in a convenient location during application. Where cap 224 is, put on to the bottom of sheath 222, cap 224 pushes nub 244 up to cause sponge holder 220 and sponge 226 to emerge partially from sheath 222. The user may then further extend sponge holder 220 and sponge 226 by pushing nub 244 or pulling on sponge holder 220 to slide sponge holder 220 out of track 240. Sponge holder 220 will stop sliding out of sheath 222 when nub 244 contacts the end of slit 242. Thus exposed, liquid foundation may be dispensed onto the exposed surface of sponge 226. The user may then hold sponge holder 220 and sheath 222 and begin applying liquid foundation with sponge 226. By holding sponge holder 220 and sheath 222 the user does not have to touch sponge 226 and may tend to avoid soiling his or her fingers with liquid foundation which may seep through sponge 226.

Sponge 226 is preferably removeably attached to sponge holder 220 by glue. As discussed above with respect to other embodiments of the invention, alternative means for attaching sponge 226 to sponge holder 220 are possible.

When the user has finished applying liquid foundation with applicator 210, he or she may slide sponge holder 220 and sponge 226 back into its retracted position within sheath 222 using nub 244. Cap 224 is removed from the bottom of sheath 222 and replaced back onto the top of sheath 222 to enclose sponge holder 220 and sponge 226 therein. Cap 224 is preferably sized so as to fit onto sheath 222 with a friction fit which will tend to prevent cap 224 from freely falling off of sheath 222.

When cap 224 is in place on sheath 222, sponge holder 220 and sponge 226 are protected from airborne dust and dirt and other contaminants. Thus, applicator 210 tends to protect sponge 226 from sources of unhygienic contaminants. In addition, applicator 210 may be carried in a bag or purse and will tend to protect other articles in such bag or purse from being soiled by liquid foundation present on sponge 226.

Applicator 210 and sponge holder 220 are preferably sized to accommodate a conventional foam wedge sponge. It will be appreciated that the design and shape of applicator 210 may be modified accordingly in order to accommodate different sizes and shapes of sponges. Additionally, sheath 222 may have other shapes and designs such as a rounded or hand grip shape which may more comfortably fit in a user's hand. Furthermore, it will be appreciated that other means for allowing sponge holder 220 and sponge 226 to move in and out of sheath 222 may be provided.

Figure 16:
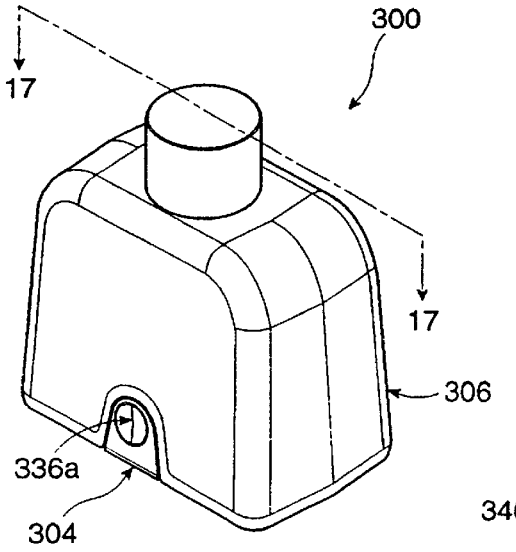
FIG. 16 is a three dimensional view of an example of a liquid dispenser and applicator according to a fifth alternative embodiment of the invention.
Figure 18:
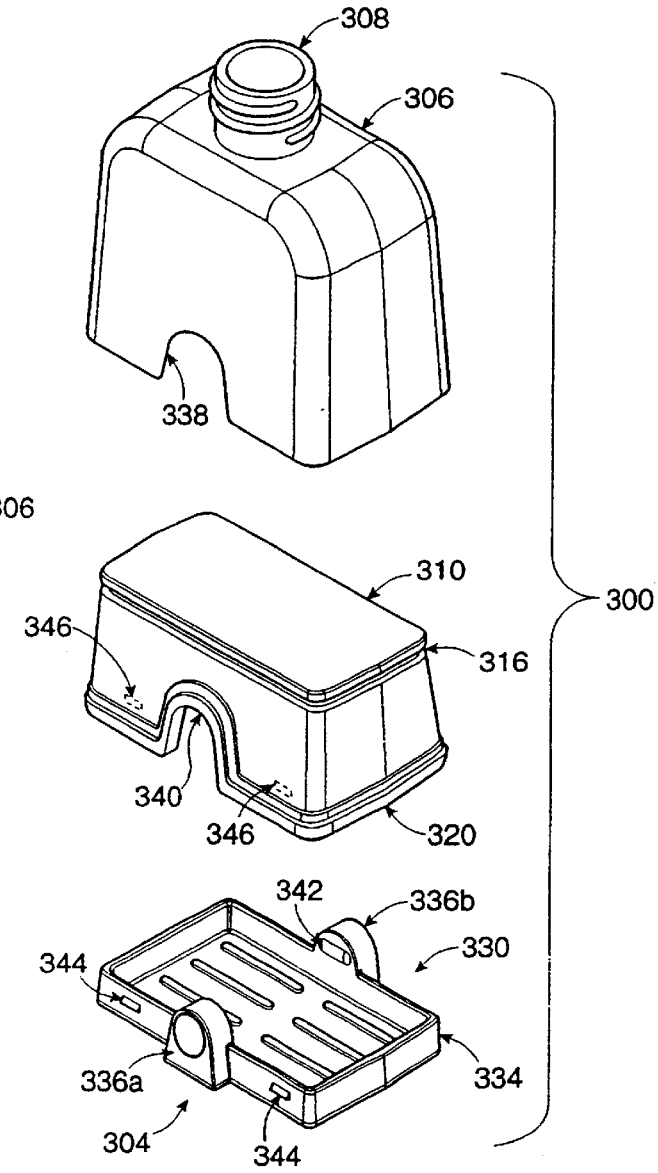
FIG. 18 is an exploded view of the dispenser and applicator of FIG. 16.
Figure 17:
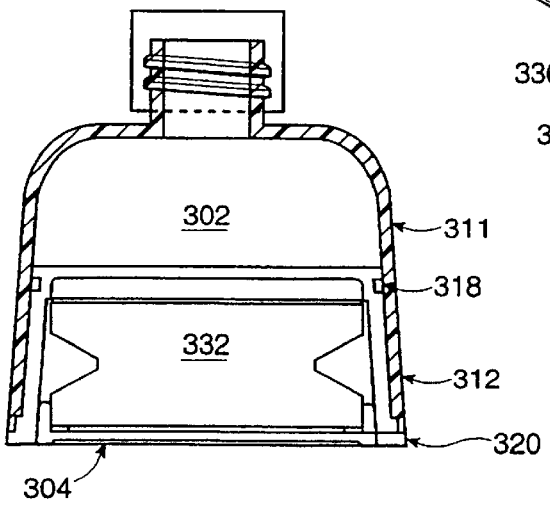
FIG. 17 is a cross-sectional view of the dispenser and applicator of FIG. 16 taken along line 17—17.

Referring to FIGS. 16, 17 and 18, yet another alternative embodiment a liquid dispenser and applicator 300 is shown which comprises a reservoir 302 (seen best in the cross-sectional view of FIG. 17) and a detachable applicator 304 nestled underneath the reservoir such that the reservoir and applicator are in a vertically stacked relationship. The reservoir 302 contains the liquid foundation and the applicator 304 may be used to apply the liquid foundation to the user's skin.

Structurally, the reservoir 302 is constructed from a hollow outer shell 306 (shown in isolation in FIG. 18) which features a bottleneck 308. A divider 310 is mounted within the shell 306 so as to compartmentalize the shell 306 into an upper chamber 311 (see FIG. 17), which functions as the reservoir 302, and a lower chamber 312, which provides a well or space into which the applicator 304 may be nestled when not in use. In the illustrated embodiment the divider 310 features a groove 316 at an upper portion thereof into which an O-ring 318 (see FIG. 17) or similar sealing material is inserted. In assembly, the divider 310 is inserted into the shell 306 and bonded thereto. The two parts have corresponding vertical tapers, as seen best in FIG. 17, and the divider 310 features a ridge 320 which functions as a stop in order to locate the divider 310 within the shell 306.

The applicator 304 comprises a cradle 330 onto which an applicator element such as a sponge 332 (shown only in the cross-sectional view of FIG. 17) is mounted, in one of the manners previously described. The sponge 332 is preferably bellows-shaped as shown in order to be more readily compressible in the vertical direction. The cradle 330 includes a tray 334 having sidewalls and integrated wings or finger grips **336*a* and 336*b* integrated into and projecting above the sidewalls which allow a user to grasp the applicator with one's fingers. Recesses 338 and 340 are formed in the shell 306 and divider 310 to accommodate the finger grips 336*a* and 336*b*. On the internal side, the finger grips feature protrusions 342** which aid in maintaining the sponge to the tray via a friction fit.

A detent mechanism is employed for detachably mounting the applicator 304 to the divider 310 (which is fixed to the shell/reservoir). More specifically, the tray 334 and divider 310 are preferably constructed from a mildly deformable and resilient plastic material, as known in the art per se. The tray 334 includes nubs 344 along the sidewalls thereof, and the divider 310 includes on its inner surface correspondingly aligned dimples 346 (shown in phantom in FIG. 18) for receiving the nubs 344. The reverse arrangement is also possible. Given the tight fit between sidewalls of the tray 334 and the divider 310, the nubs 344 cause the walls of divider 310 and shell 306 to flex outwardly as the tray 334 is inserted therein, but the pressure is relieved as the nubs 344 are received in the dimples 346. The pressure, which must be relieved in order to remove applicator 304, locks the applicator 304 in place. The applicator 304 may, however, be removed by forcibly pulling or tugging the tray 334 out from its attached position. Once removed, the user may pour the liquid foundation stored in the reservoir 302 onto the applicator 304.

Figure 19:
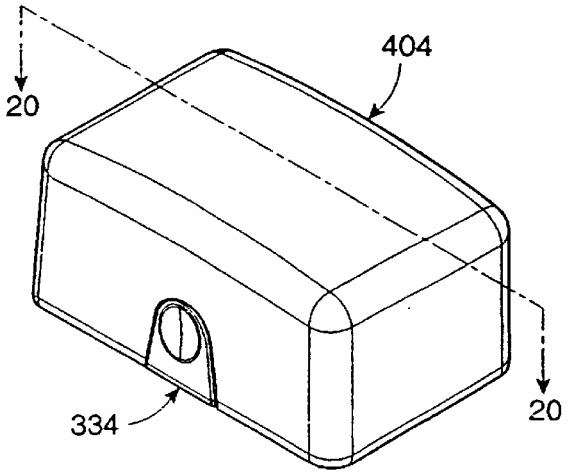
FIG. 19 is a three-dimensional view of an example of an applicator according to a sixth alternative embodiment of the invention.
Figure 21:
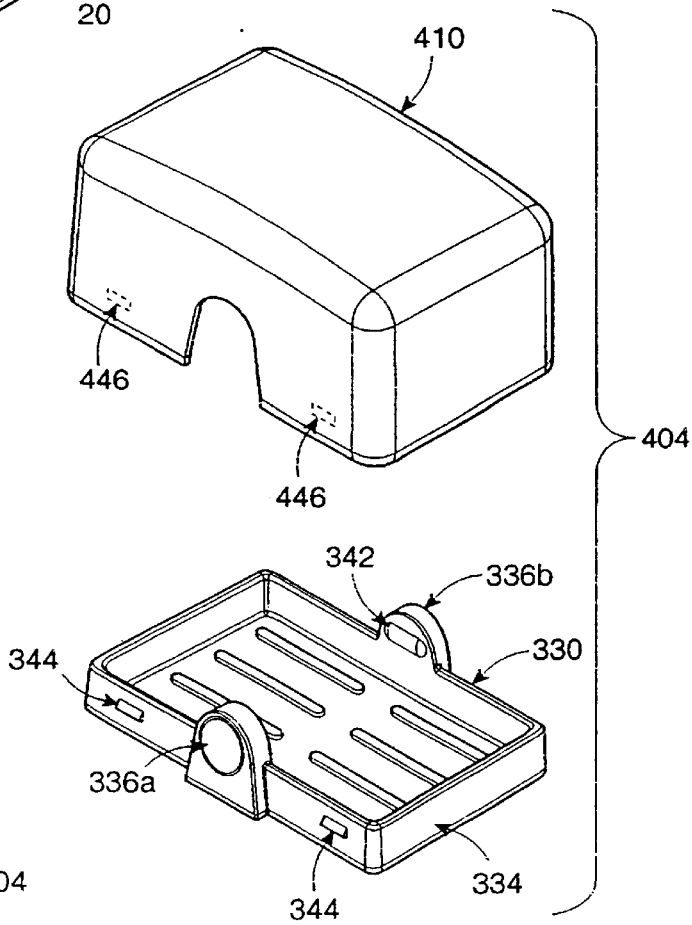
FIG. 21 is an exploded view of the applicator of FIG. 19.
Figure 20:
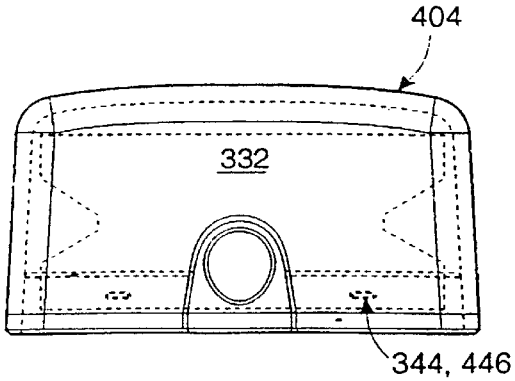
FIG. 20 is a cross-sectional view of the applicator of FIG. 19 taken along line 20—20.

Referring to FIGS. 19, 20 and 21, an applicator 404 according to another embodiment of the invention is shown. The applicator 404 is substantially similar to applicator 304 shown and described with reference to FIGS. 16–18 with the exception that finger grips **336*a* and 336*b* have a narrow profile. This narrower profile enables the applicator 404 to sit in flush-mounted relationship to a lid 410 which features dimples 446 (shown in phantom in FIG. 21) on its inner surface for receiving the nubs 344 of tray 334. The applicator 404 offers similar advantages as sponge holder 120 of FIG. 10. In addition, the lid 410 protects the sponge 332 from unwanted contact. This enables the applicator 404 to be carried in a handbag without the risk of soiling the other contents of the handbag. The lid 410 also keeps the sponge 332** free from dirt and other contaminate.

The embodiments of the invention have been described herein with reference to dispensers and applicators for use with liquid foundation cosmetics. It will be appreciated that the invention is not limited to use with liquid foundation cosmetics, but may also be used for other types of liquids which are applied with a sponge or other type of applicator. For example, the invention may be applied to other types of liquid cosmetics, suntan lotion or medical lotions or ointments. The invention may also be applied to uses where the liquid is not applied to a person's skin. For example, the invention may provide a paint dispenser and applicator. In addition, the invention has been described herein by way of example only and various modifications of detail and design may be made to the invention, all of which come within its spirit and scope.

A preferred embodiment has been described in detail and a number of alternatives have been considered. As changes in or additions to the above described embodiments may be made without departing from the nature, spirit or scope of the invention, the invention is not to be limited by or to those details.

We claim:

1. A liquid dispensing apparatus comprising:

a reservoir for containing a liquid, the reservoir having at one end thereof a spout whence to dispense the liquid;

an applicator nestled underneath the reservoir such that the reservoir and applicator are in a vertically stacked relationship;

a detent mechanism for attaching the applicator to the reservoir, the applicator being detachable from the reservoir in order to receive liquid from the spout and permit the applicator to be used to apply the liquid to a surface.

2. The liquid dispensing apparatus of claim 1, wherein the applicator comprises:

a sponge holder; and a sponge attachable to the sponge holder.

3. The liquid dispensing apparatus of claim 1, wherein the reservoir is formed from an outer shell having a bottleneck and a divider mounted within the shell which compartmentalizes the shell into an upper chamber for storing the liquid and a lower chamber for storing the applicator, the upper chamber including the bottleneck.

4. The liquid dispensing apparatus of claim 3, wherein:

the applicator comprises a tray, having sidewalls, into which a sponge is mounted, the tray having finger grips integrated into and projecting above the sidewalls for enabling the applicator to be grasped by a person's fingers; and the shell includes recesses to accommodate the finger grips.

5. The liquid dispensing apparatus of claim 4, wherein the detent mechanism comprises one or more nubs formed in one of the tray sidewalls and co-operating dimples formed in the divider.

6. An apparatus comprising:

a sheath having an open end;

an applicator for receiving a liquid and applying the liquid to a surface, the applicator being slidably receivable in the sheath and being removable from the open end of said sheath, the liquid being dispensable onto the applicator when the applicator is withdrawn from said sheath; and a cover for closing the open end of the sheath when the applicator is enclosed in the sheath;

wherein the applicator comprises a sponge holder and a sponge attachable to and detachable from the sponge holder.

* * * * *